US012708815B2

(12) United States Patent
Koerner et al.

(10) Patent No.: US 12,708,815 B2
(45) Date of Patent: Aug. 18, 2026

(54) VARIABLE LOAD BILATERAL DEADLIFT MACHINE

(71) Applicant: United States Performance Center, LLC, Charlotte, NC (US)

(72) Inventors: David Koerner, Waxhaw, NC (US); Irwin Belk, II, Charlotte, NC (US)

(73) Assignee: United States Performance Center, LLC, Charlotte, NC (US)

( * ) Notice: Subject to any disclaimer, the term of this patent is extended or adjusted under 35 U.S.C. 154(b) by 121 days.

(21) Appl. No.: 18/765,693

(22) Filed: Jul. 8, 2024

(65) Prior Publication Data

US 2025/0010138 A1 Jan. 9, 2025

Related U.S. Application Data

(60) Provisional application No. 63/512,415, filed on Jul. 7, 2023.

(51) Int. Cl.
*A63B 24/00* (2006.01)
*A63B 23/035* (2006.01)
(Continued)

(52) U.S. Cl.
CPC .... *A63B 24/0087* (2013.01); *A63B 23/03516* (2013.01); *A63B 23/0405* (2013.01);
(Continued)

(58) Field of Classification Search
CPC ..... A63B 21/00058; A63B 21/00069; A63B 21/00076; A63B 21/008; A63B 21/0083;
(Continued)

(56) References Cited

U.S. PATENT DOCUMENTS 7,462,141 B1 * 12/2008 Raboin ..... A63B 21/225 482/110
2009/0192026 A1 * 7/2009 Mason ..... A63B 21/4035 482/97

(Continued)

FOREIGN PATENT DOCUMENTS

CN 108283791 A * 7/2018 ..... A63B 71/0619
DE 102021005483 A1 * 5/2023 ..... G09B 19/0038

*Primary Examiner* — Gary D Urbiel Goldner
(74) *Attorney, Agent, or Firm* — Kim and Lahey Law Firm, LLC; Douglas W. Kim

(57) ABSTRACT

A variable load unilateral and bilateral trap bar deadlift machine comprising: a frame having a base platform; a controller in communication with a display; a set of independent lever arms pivotally carried by the frame; a handle attached to each lever arm; a load controller in communication with each lever arm; wherein the controller is adapted to receive load input, determine a corresponding load setting for the load controller, transmit the load setting to the load controller, receive performance information such as grip strength, lift speed, power, weight, etc., and display the performance information on the display. Capabilities of the machine include analyzing performance data from each side of the body independently; use in combination with external devices such as force plates for further time series performance evaluation; and neuromuscular evaluation and training for populations such as high-performance athletes, tactical operators, rehabilitative patients, and more.

20 Claims, 11 Drawing Sheets

(51) Int. Cl.
*A63B 23/04* (2006.01)
*A63B 71/06* (2006.01)

(52) U.S. Cl.
CPC ..... *A63B 24/0021* (2013.01); *A63B 24/0062* (2013.01); *A63B 24/0075* (2013.01); *A63B 71/0622* (2013.01); *A63B 2023/0411* (2013.01); *A63B 2024/0056* (2013.01); *A63B 2024/0068* (2013.01); *A63B 2071/065* (2013.01); *A63B 2208/0204* (2013.01); *A63B 2220/20* (2013.01); *A63B 2220/30* (2013.01); *A63B 2220/58* (2013.01); *A63B 2220/833* (2013.01); *A63B 2225/093* (2013.01)

(58) Field of Classification Search
CPC ..... A63B 21/0085; A63B 21/0087; A63B 21/159; A63B 21/4035; A63B 23/03508; A63B 23/03516; A63B 23/0405; A63B 23/0482; A63B 2023/0411; A63B 24/0021; A63B 24/0062; A63B 24/0075; A63B 24/0087; A63B 2024/0056; A63B 2024/0068; A63B 71/0622; A63B 2071/027; A63B 2071/065; A63B 2208/0204; A63B 2208/0223; A63B 2220/20; A63B 2220/30; A63B 2220/51; A63B 2220/52; A63B 2220/58; A63B 2220/833; A63B 2225/093; A63B 2225/20; A63B 2225/50; A63B 2244/09
See application file for complete search history.

(56) References Cited

U.S. PATENT DOCUMENTS

| | | | | |
|---|---|---|---|---|
| 2011/0118090 | A1* | 5/2011 | Ellis | A63B 21/4017 482/133 |
| 2012/0040799 | A1* | 2/2012 | Jaquish | A63B 23/0355 482/9 |
| 2012/0058866 | A1* | 3/2012 | Hongo | A63B 21/068 482/131 |
| 2012/0109025 | A1* | 5/2012 | Weinberg | A63B 24/0087 601/5 |
| 2020/0188719 | A1* | 6/2020 | Brand | A63B 21/4029 |
| 2023/0110120 | A1* | 4/2023 | Small | A63B 21/002 482/6 |

* cited by examiner

VARIABLE LOAD BILATERAL DEADLIFT MACHINE

RELATED APPLICATIONS

This application incorporates by reference U.S. Patent Applications 63/485,891 filed Feb. 18, 2023 and 63/499,217 filed Apr. 29, 2023 incorporated by reference.

BACKGROUND OF THE INVENTION

1) Field of the Invention

This invention provides for a bilateral deadlift design that promotes safe and effective evaluation and training use in a variety of rehabilitation, preventive, athletic and non-athletic populations. This design provides for the direct measurement of performance through individual repetition analyses of velocity, power, force, range of motion, and more. This machine utilizes two deadlift handle "arms" that move independently and collect data for each side respectively. The design of the machine provides for safer execution of the deadlift exercise than standard machines in the field. The exercise machine can be used for those interested in improving physical performance from medical patients undergoing rehabilitative programs, to everyday individual wishing to be more active with their lifestyles, to professional athletes, to tactical athletes such as military, first responders, and the like. The machine can be integrated with a comprehensive and individualized performance evaluation system.

2) Description of the Related Art

Deadlifts are one of the most commonly used exercises to promote physiological adaptation in athletes, tactical populations, and the general public. Deadlifts can be performed in a variety of positions which all elicit slightly different adaptations. Conventional deadlifts and trap bar style deadlifts are among the most popular variations of the deadlift exercise and have both been shown to elicit significant strength and power adaptations in athletes. Conventional deadlifts are typically performed with a straight iron bar and may place more stress on the lower back when performed without exceptional technique. A trap bar deadlift is typically performed with a hexagon shaped iron bar and is generally considered safer for athletes. Therefore, trap bar deadlifts are the commonly preferred variation used in exercise facilities across the country. Currently these exercises are performed with an iron bar on the floor. Attempts may be made to measure performance by measuring the total load moved, measuring the velocity of the movement with an external device (i.e., linear transducer), or performing the exercise on top of force plates to identify ground reaction forces. These methods of measuring deadlift performance require several pieces of equipment and can be expensive and cumbersome to set up. In addition, the performance metrics that are provided may be limited (e.g., a single metric such as velocity). Further, the data collected is evaluated in isolation without integration in a holistic whole-body performance evaluation.

BRIEF SUMMARY OF THE INVENTION

The above objectives are accomplished by providing an exercise machine design that incorporates built-in evaluation and performance monitoring capabilities that benefit a target individual such as athletes, rehabilitation patients, first responders, warfighters (e.g., soldier), and the like. In another embodiment, the machine may integrate with a system designed for individualized evaluation and performance monitoring. The machine can include a load controller for applying a load to a limb of a target individual; a force/load sensor in electrical communications with the force/load sensor for determining the force/load applied to the limb and the target individual uses the exercise machine; a velocity sensor for receiving velocity information representing the force applied to the load by the target individual; and, computer system in communications with the sensors for determining base line power, receiving load information, receiving velocity information, range of motion information, force information, and determining modifications in the load applied to the target individual.

The system can include a variable load bilateral trap bar deadlift machine comprising: a frame having a base platform; a controller in communications with a display; a set of lever arms pivotally carried by the frame; a handle attached to each lever arm; a load controller attached to each level arm; wherein the controller is adapted to receive load input, determine a corresponding load setting for the load controller, transmit the load setting to the load controller, receive performance information such as grip strength, lift speed, power, weight, range of motion etc. and display real-time performance information on a display.

BRIEF DESCRIPTION OF THE SEVERAL VIEWS OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF THE INVENTION

With reference to the drawings, the invention will now be described in more detail. The current invention is presented as a novel trap bar deadlift machine design that promotes athlete safety and performance evaluation. This machine can allow for in-depth evaluation of unilateral (left and right) performance metrics collected during a deadlift exercise. This type of evaluation allows for targeted performance evaluation and training and therefore may lead to greater improvements in strength and power production that can benefit a wide variety of individuals (i.e., athletes, tactical populations, stroke users, youth, general population). This machine can be a combination of hardware and software so that the equipment is adjustable to the size of the user and has the ability to provide biofeedback data using sensors and a controller to the user and others during their performance and also allow for the transmission of data to external sources for analyses. The machine can have two separate lever arms that function and measure performance independently. In one embodiment of the machine, additional configurations can exist allowing adaptation of the machine to additional exercise such as split squats, loaded jumps, bench press, curls, and a variety of similar exercises.

The data from the machine could be integrated with external devices such as force plates to provide time series data of an individual's exercise. The system could overlay the time series data from the machine and from the force plates to provide greater in-depth performance analysis. The machine may integrate with evaluation and training systems that incorporate additional machines and software.

This system can be used for health care purposes such as neurological treatment and rehabilitation, physical exercise, high performance athletes, military operator to treat or prevent injuries and other applications.

Figure 1:
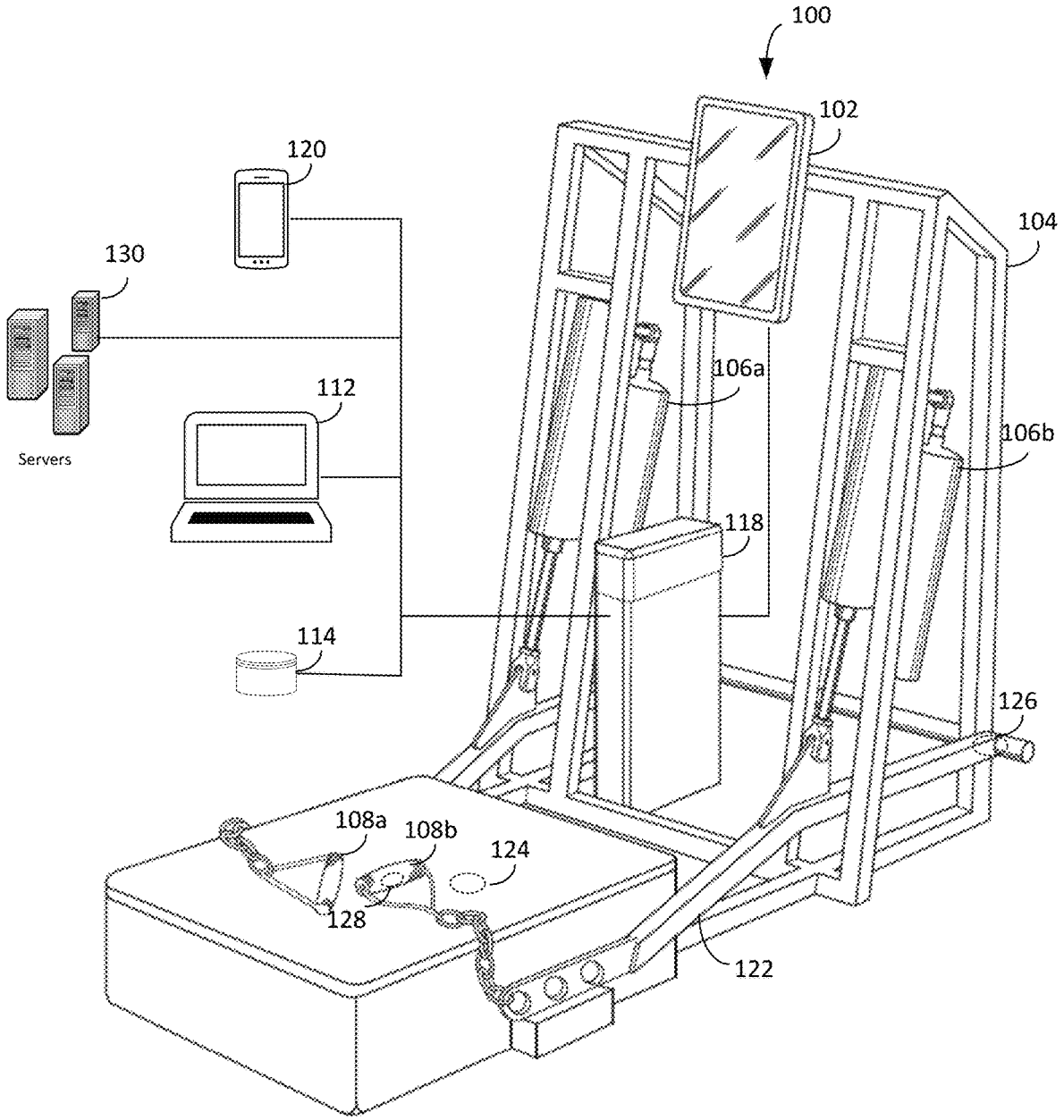
FIG. 1 is a perspective view of the one embodiment of the machine that can be used with the system.

Referring to FIG. 1, a deadlift machine 100 is shown having a computer device 102 that can receive and transmit information. A touch screen can be included in the computer device. The load (e.g., weight) can be adjusted manually by buttons included on the computer device, the handles, the housing or carried by the frame 104 in one embodiment. In another embodiment, the load can be adjusted automatically by using an attached computer system. The machine can use a set of load assemblies 106*a* and 106*b* (e.g., cylinders) so that the machine can determine the force, speed, velocity, range of motion, and power of each independent lever arm that is in motion. The cylinders can be controlled jointly or separately. The target individual, in one embodiment can use handles 108*a* and 108*b* that can be pulled upwards, one in each hand.

The system can transmit and receive information to one or more remote computer systems 112 and storage systems 114. The load can be varied manually or automatically with computer readable instructions on the controller, information received from a communications port included on the computer or load controller 118 or input from an input device such as a keyboard, touch screen or portable device 120 in communications with the controller. Components can be in communications with wired or wireless communications.

The load controller 118 can include or be connected to an air cylinder, motor, fly wheel with variable resistance, transmission, and the like. The load controller can provide resistance to levers 122 and therefore the target individual without the impact of gravity. For example, when input is received at the controller, the resistance of the load controller can vary without consideration of gravity which is in opposition to traditional exercise equipment such as free weights. The load controller can include components that allow changes to be made to the load by typing a desired load on the display. In one embodiment, the load controller can be omitted and the load can be changed using the buttons on the handles instead of typing a number in the display.

The controller can also be connected to one or more sensors 124 that can gather information about the exercise machine and its components, the activities, and the target individual. For example, sensor 126 associated with the levers can determine the force placed on the levers, the distance that the levers travel, the speed in which the levers travel, the acceleration of the levers, repetitions, and the like. A sensor 124 can be included in the platform where the individuals stand to determine the weight of the target individual, and the forces applied against the platform. Sensor 128 can determine the gripping force of the target individual on the handles 108*a* and 108*b* including forward, rearward, and lateral force placed on the handle. One or more sensors can transmit the information to the controller which can be used to display on a screen or portable device. The equipment can be used with one or both levers at a time.

The controller can be connected to a server 112 or other computer system, which can be local or remote. The controller can be in communications wirelessly, wired, local network, wide area network of global communications network. Information can be transmitted to and from the server and the controller. The server can be in communications with an aggregate server 130 and database 114 that can also be in communications with additional servers. The controller can include a computer readable medium for data storage, can be in communications with a local or remote data storage system and can include a removable data storage system.

The controller of the machine, or a computer system in communications with the machine, can detect through sensors and display locally or remotely information that includes resistance, force, load, velocity, vectors, acceleration, power, distance, speed, repetitions, range of motion and the like. The machine can measure each of these unilaterally or bilaterally. In one embodiment, the sensors and controller include an output of data without calculations. In such embodiment, the controller serves as a data for computer readable instructions that can be disposed locally or remote to the equipment.

The data from the machine can be used to create a load-velocity profile and power curve that can be associated with a target individual, date, time, repetition, set, session and the like. In calculating the velocity, the following equation can be used:

$$v = \frac{d}{t}$$

where v is the velocity, d is the change in distance and t is the change in time so that velocity is calculated by determining the distance that the lever(s) traveled and determine a period of time when lever(s) traveled from an initial position to a final position and can be measured in length units per time units. The computer readable instructions can also calculate the force that is applied by the target individual. The force can be represented by the following equation:

$$F = m * a$$

where F is the force, m is the mass and a is the acceleration. The mass can be determined by translating the resistance into mass and the acceleration can be determined by the following equation:

$$a = \frac{\Delta v}{\Delta t}$$

where a is acceleration, Δv is the change in velocity over the change in time, Δt. The computer readable instructions can determine power from the following equation:

$$P = \frac{W}{\Delta t}$$

where power P is calculated by diving work, W, in the change in time Δt. Work can be calculated by the following equation:

$$W = Fs$$

where work, W can be calculated from force times displacement wherein displacement s represents the change in the position of the foot pedal. In the example, of a lever arm, the displacement can be the arc that the foot pedal travels around the pivot as well as the line between the starting point and the ending point. The data from several distinct repetitions can be gathered and generated into a power curve by determining the power, such as in watts, over the course of several repetitions performed at different load intensities.

This machine allows for the completion of bilateral and unilateral strength and power tests to measure left and right hemispheres of the individual performing repetitions at the same time or completely independently. The machine can also be used to perform exercise training while providing real-time performance data.

The machine can be integrated with a comprehensive individualized performance evaluation and training system. The system, for which the present machine can be a component, can include computer readable instructions that can determine performance metrics such as estimated maximal load, peak power, and power velocity and symmetry comparisons between limbs. The computer readable instructions can determine the initial status of the users, an initial workout scheme according to the data received from the sensors and subsequently modify that workout scheme according to the data received from the sensors. The workout scheme can be determined using an iterative process from data from the recent workouts. The computer readable instructions can be adapted for receiving load information, receiving velocity information, and determining modifications in the load applied to the user are repeated for each user session. The workout scheme can be determined according to the data received from the sensors and a user's characteristics. The computer readable instructions can determine a workout scheme according to the data received from the sensors and a dataset of prior user characteristics as well as wherein the user characteristics match those of another user characteristics in the dataset.

The system can include an exercise machine, such as the one described here, having a load controller for applying a first load to a first limb of a user and a second load to a second limb of the user; a first load sensor adapted to determine a first force applied by the first limb by the user; a second load sensor adapted to determine a second force applied by the second limb by the user; a first velocity sensor for receiving a first velocity information associated with the first force; a second velocity sensor for receiving a second velocity information associated with the second force; and, computer system in communication with the first load sensor, the second load sensor, the first velocity sensor, the second velocity sensor and adapted to determine a base line power for the first limb and the second limb according to the first force, the second force, the first velocity information, and the second velocity information receive an initial training program, and determine a modification to the initial training program according to receiving a subsequent force and a subsequent velocity information.

The computer system can be adapted to determine an estimated maximal load, determine a peak power and power velocity, determine a peak power and a power velocity for each limb, determine the modification of the initial training program according to an iterative process using a set of date received from the first load sensor, the second load sensor, the first velocity sensor and the second velocity sensor to provide a subsequent training program, repeat an iterative process for each subsequent user workout session, determine the initial training program according to a user's characteristics, determine the initial training program according to a dataset of prior user characteristics, and determine the initial training program according to a record from a past user dataset wherein a current user characteristic matches a prior user characteristic in the past user dataset.

The system can determine performance metrics according to the performance dataset and the subsequent dataset, determine a symmetrical comparison between a first limb and a second limb, determine the modification to the initial program according to a determination of a peak power, a power velocity, a symmetry comparison, and any combination thereof.

This system may include assistance and instructions that can accompany training for maximal voluntary activation of the nervous system to promote greater functionality. This system can also train involuntary activation by using electrical or magnetic stimulation. In one embodiment, this system is not passive, but rather directly targets the nervous system that can meet the user at their current ability levels.

The system can vary the first load according to the modification to the first load. The modification to the first load can be according to a determination of a peak power, a power velocity, changes in power, range of motion, a symmetry comparison, and any combination thereof. The modification to the first load can be iterative until an alignment of a right power velocity calculation and a left power velocity calculation occurs or until a target metric is achieved.

In one embodiment, the system provides real-time biofeedback allowing the target individual to see their performance for every repetition. This allows for maximal voluntary effort. In another embodiment, the performance training plan can include additional processes and equipment including surface muscle stimulation or transcranial magnetic stimulation which can improve and accelerate the regeneration of neural pathways, particularly after an injury. Electrical stimulation can elicit greater nervous system recruitment by activating motor neurons that may currently be inhibited under voluntary activation. For example, electrical stimulation may be used on a target individual's leg muscles when completing a deadlift. This would allow them to produce more force and velocity. The system can use electrical stimulation (such as with surface EMG or transcranial magnetic stimulation) that can activate involuntary neural responses to cause greater neural output than voluntary effort alone.

In one embodiment the machine can be used in conjunction with force plates or sensors placed on the machine platform. When used as part of the neuromuscular evaluation system the software could overlay the time series data from the machine and from the force plates or sensors to provide simultaneous real-time analysis. This would allow for a kinetic analysis of the forces placed on the machine's levers and the ground reaction forces through the plates or sensors. This provides a near-whole body analysis of movement which can be used to identify and correct inefficient loading mechanics and asymmetries.

While the foregoing references applying loads to and measuring performance of a user's limb(s), it should be understood that the performance measured may be related to a limb, quadrant, hemisphere (i.e. side of the body), any other grouping of muscles used in harmony, and any combination thereof. In some movements, such as the dead lift, a load may be applied to a first limb, i.e. the arm, while the majority of work is performed by a second limb, i.e. the leg. In measuring performance, the system will capture the two limbs, i.e. the hemisphere, working together. For a typical user, the system will capture the mirrored action on the opposite side of the body. The system can then compare the two sets of data to perform its analysis and feedback.

The system can be tailored for populations such as high performance, tactical operators, rehabilitation, and more. The system can analyze data from strength and power assessments to make comparisons between current and ideal levels of strength, peak power, and power velocity and each of these measurements can be identified for each limb and body quadrant (e.g., lower push, lower pull, upper push, upper pull, core). Differentials (differences in performance between limbs) can be calculated for strength, peak power, power velocity and averages can be taken across multiple data points. Because the machine allows for unilateral activity and measurements, the system can provide for symmetry analysis and training to reduce injury risk, strength symmetry across all quadrants to reduce injury risk, increase current strength levels to goals (e.g., ideal) levels, attain peak power symmetry across all quadrants, increase current peak power levels to ideal levels, attain power velocity symmetry across all quadrants and increase current power velocity levels to ideal levels. These benefits through the structure and function of the system enhances the ability to improve, maintain and rehabilitate physical performance.

Figure 2:
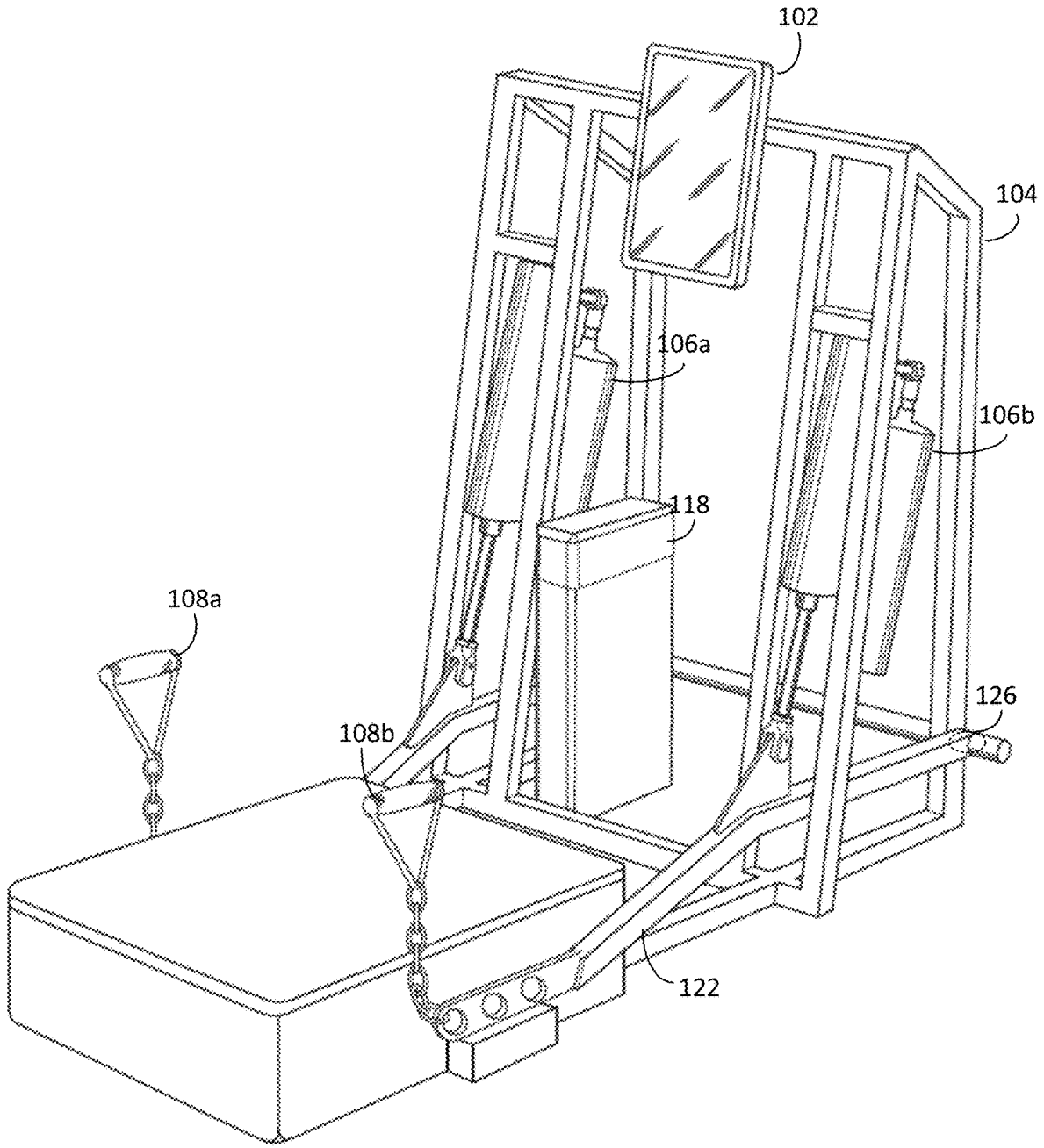
FIG. 2 is a perspective view of one embodiment of the machine.

Referring to FIG. 2, the machine from FIG. 1 is shown in another position. Handles 108*a* and 108*b* are lifted as if ready for use.

Figure 3A:
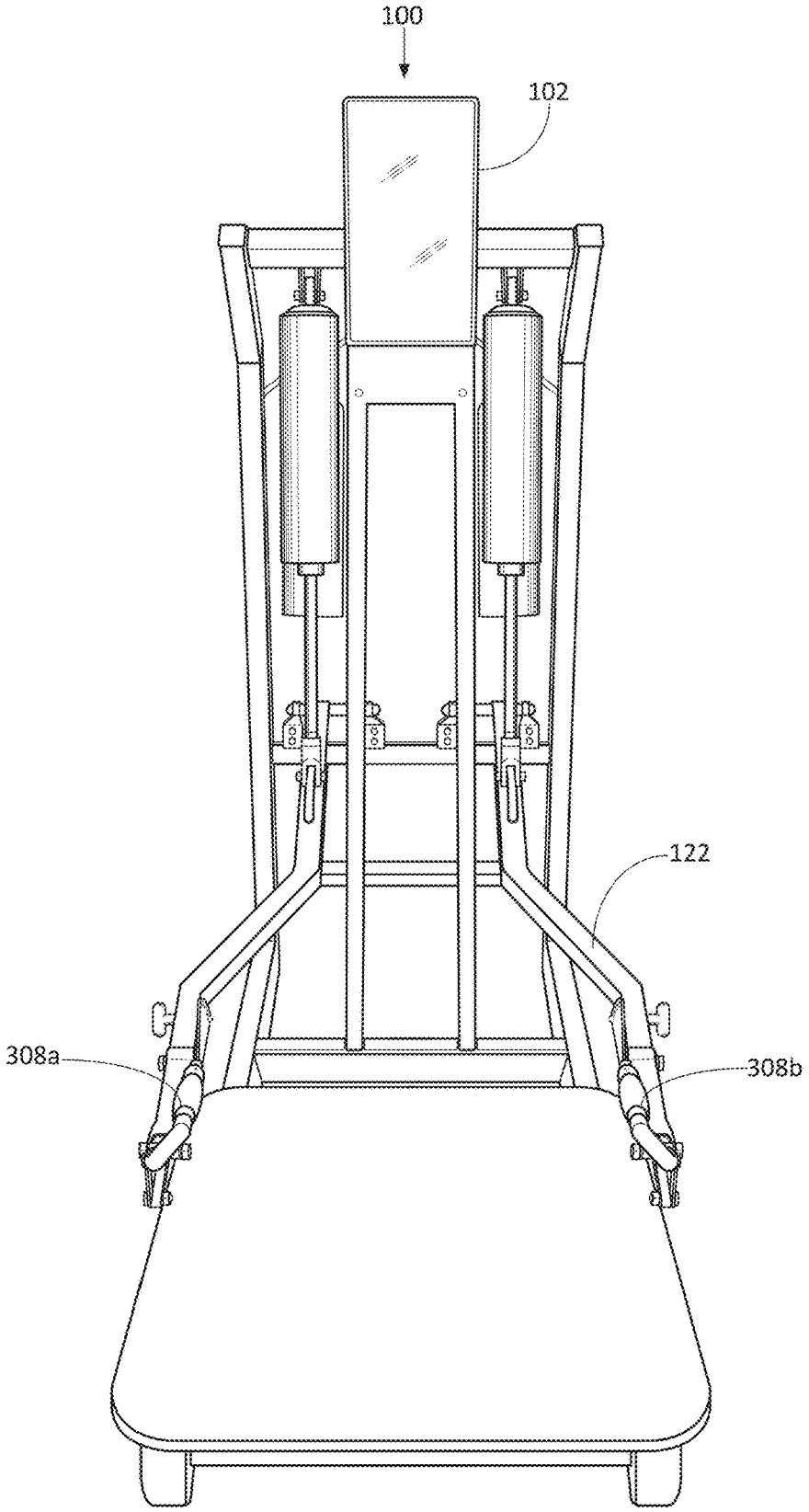
FIG. 3A is a front view of one embodiment of the machine.
Figure 3B:
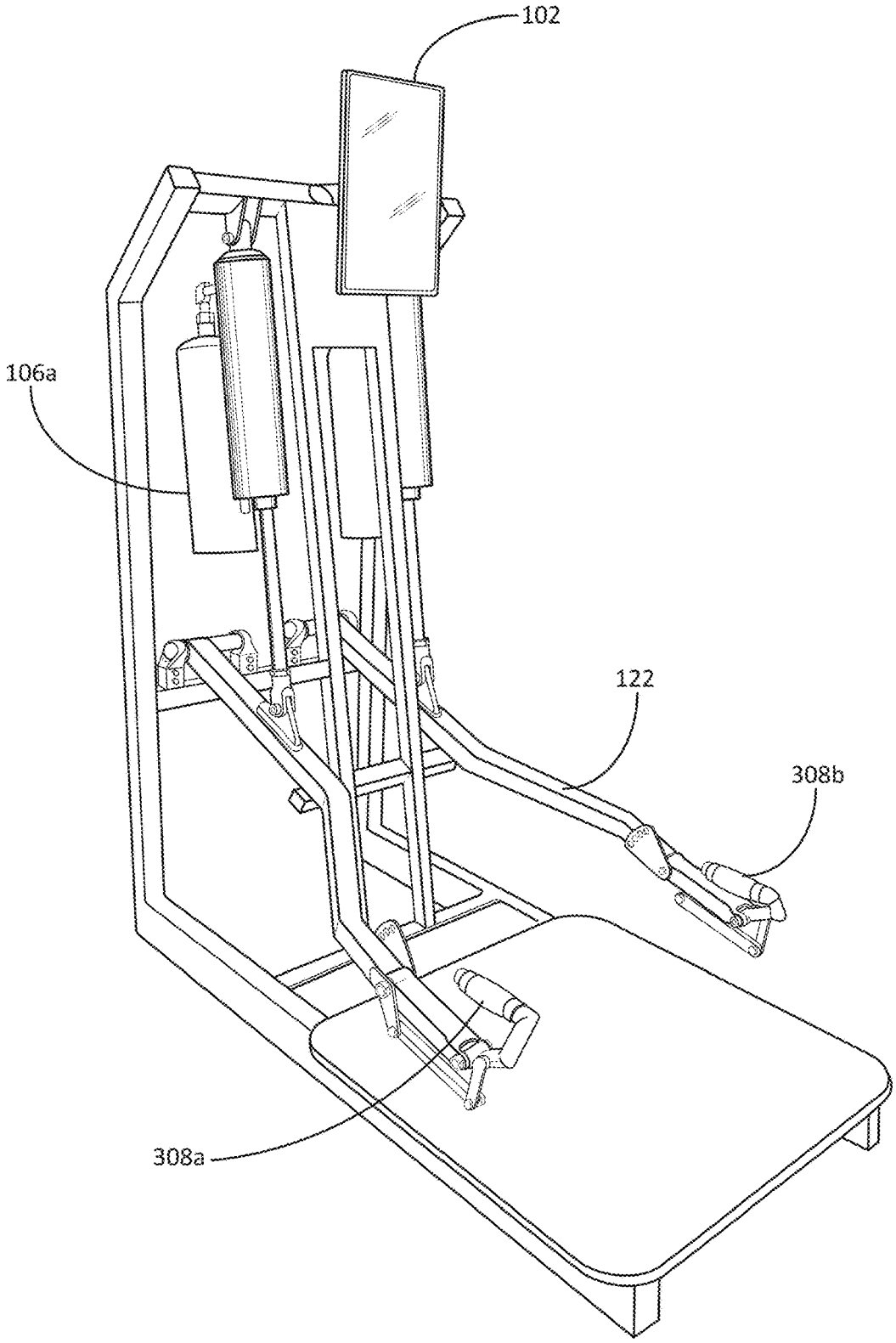
FIG. 3B is a perspective view of one embodiment of the machine.

Referring to FIGS. 3A and 3*b*, a second embodiment of a deadlift machine 100 is shown. The floor plate 310 may include a sensor to measure the pressure exerted upon the floor plate during use. Handles 308*a* and 308*b* provide an alternative configuration to handles 108*a* and 108*b* from FIGS. 1 and 2. Button 312 allows the user to manually increase or decrease the load placed on the machine. With button 312 depressed, handle 308*b* can be shifted in a first direction to increase the load or shifted in a second direction to decrease the load. Shifting the handle in this manner provides input to load assembly 106*a*. The chosen load can be displayed on computer device 102. Disengaging button 312 allows the handles to be used to exert force on lever 122 and for use of the machine for exercise, training, or treatment.

Figure 4A:
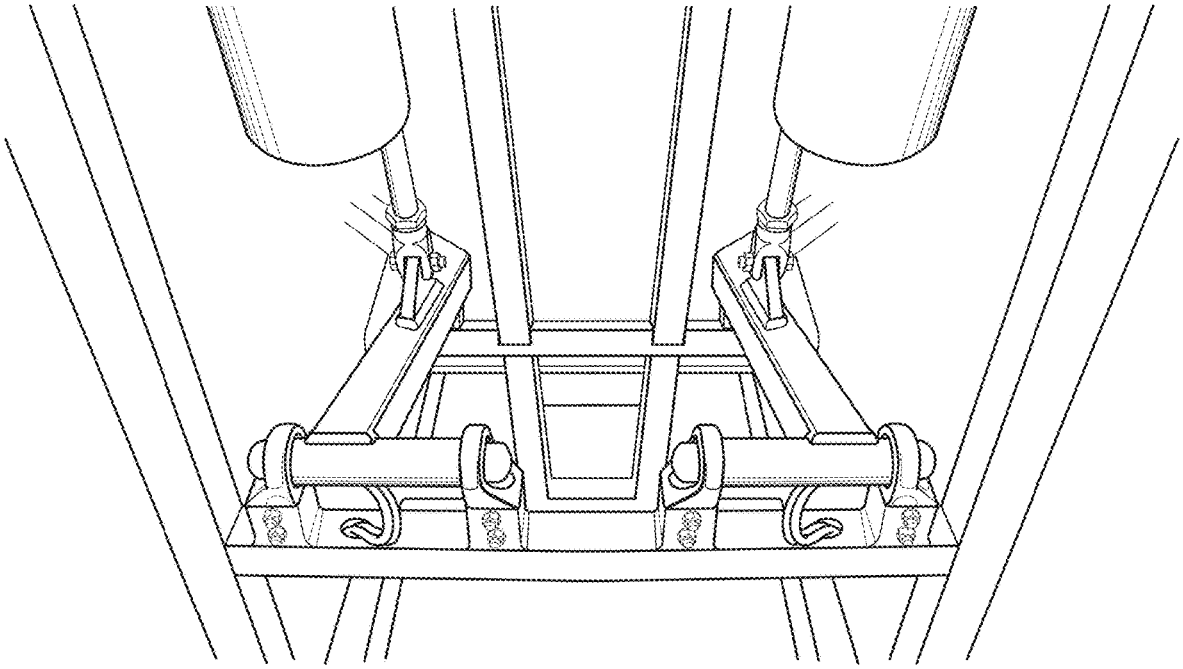
FIG. 4A is a rear view of one embodiment of the machine.
Figure 4B:
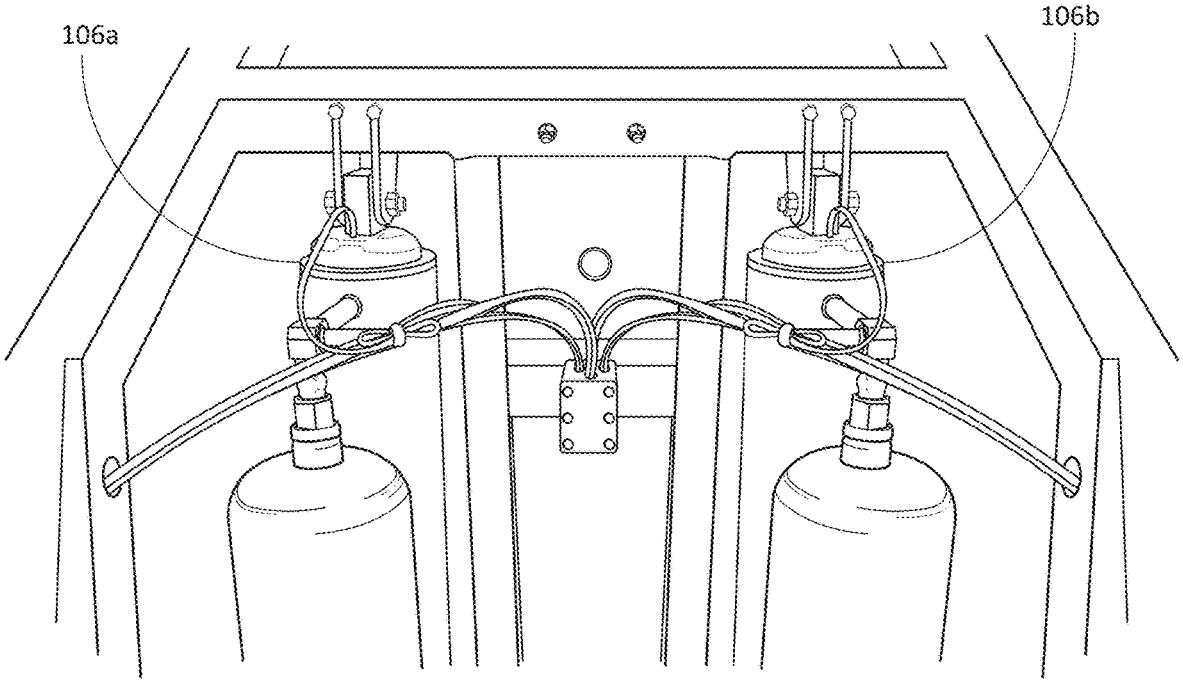
FIG. 4B is a rear view of one embodiment of the machine.

Referring to FIGS. 4*a* and 4*b*, the rear of machine 100 from FIGS. 3*a* and 3*b* is shown. Load assemblies 106*a* and 106*b* are shown in connection with the machine, hydraulic cylinders to effect a load, and the handle buttons use to adjust the load via the load assemblies.

Figure 5A:
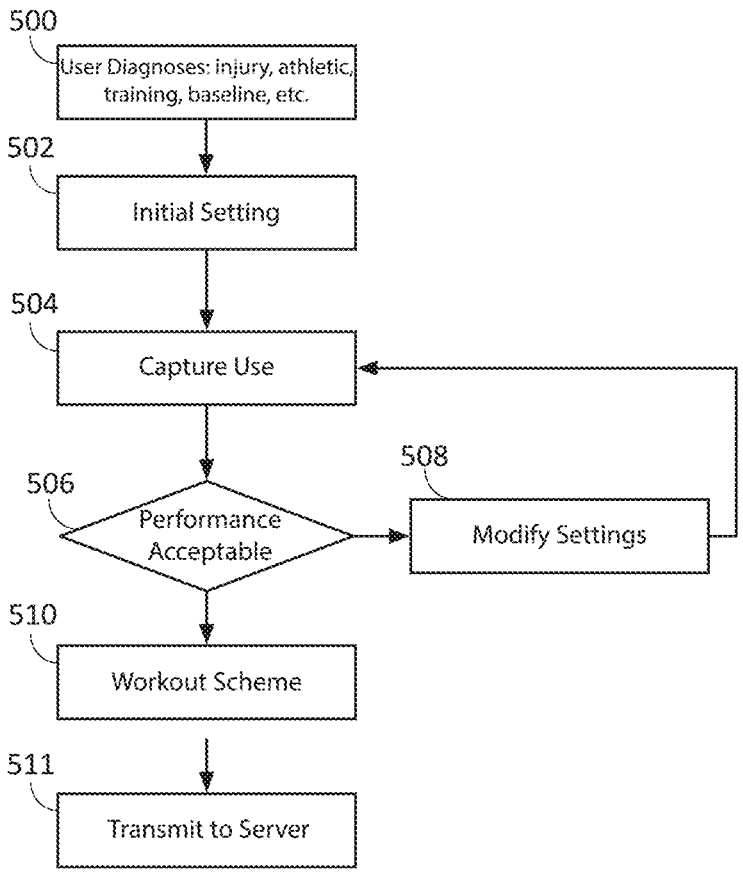
FIG. 5A is a flowchart of the operational aspects of the system.

Referring to FIG. 5A, components and the processes of the present system that can incorporate the machine described herein are shown in further detail. The system is designed for both evaluation, rehabilitation, and training and allows for continued monitoring and real-time adjustments to the user's program to provide the appropriate stimulus needed for adaptation. In one application, the system can be used to determine an initial status or evaluation of the user and provide an initial workout scheme. The initial workout scheme can be a suggested scheme or actual scheme. The workout assistant can review the initial workout scheme and modify it if needed according to the specific characteristics of the users. The functionality of the hardware and the computer readable instructions provide for a system that can begin with a diagnosis of an injury or baseline of functional performance. The user can then work with a workout assistant or other professional to develop an initial setting according to an evaluation 500. At 502 the initial setting can be established according to the injury or baseline of the user.

For example, if a determination is made that an injury is severe, the initial load on the user can be very light. If the user wishes to improve their athletic performance for sports, military tasks and the like, the load may be greater. Further, the system can access a database of prior users and retrieve initial setting from users that had similar injuries of baselines and similar criteria (e.g., age, weight, physical activity, physical shape, lifestyle, and the like). The user can then use the machine with the initial settings and the data is captured at 504. In the event that the initial setting results in inadequate performance (e.g., the load was too high) a determination can be made at 506 and the setting can be modified at 508. If the performance is acceptable, the system can generate a baseline evaluation and training program where the workout scheme begins at 510. The information, including the initial workout scheme can be transmitted to a server at 511. Information and inputs can be transmitted to and from the system from a remote device during the process. Further, the remote device can be used to monitor the activity of the system and the user during the process.

Figure 5B:
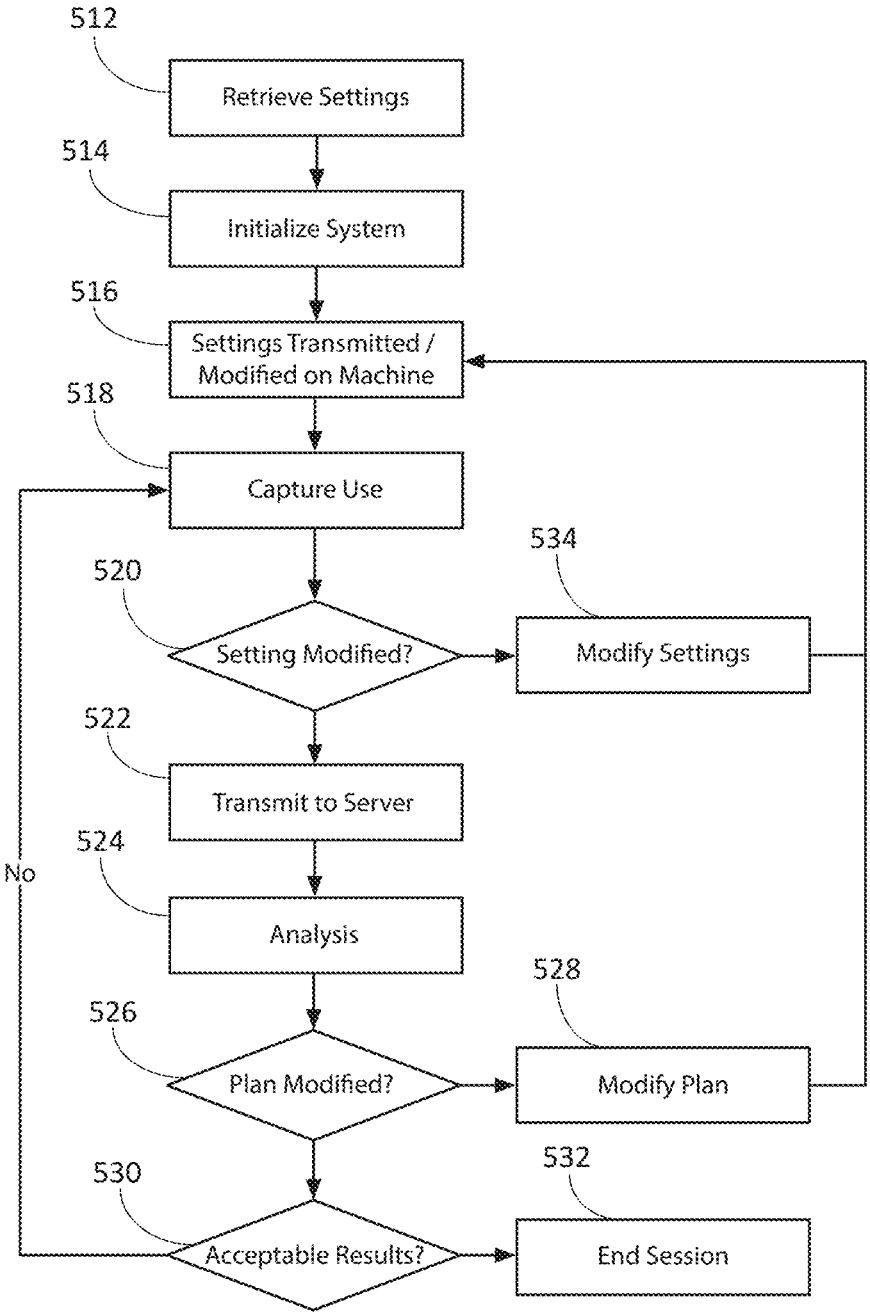
FIG. 5B is a flowchart of the operational aspects of the system.

Referring to FIG. 5B, the system can be used to facilitate and continue the rehabilitation and/or workout scheme. The most recent settings are retrieved at 512 and the machine is initialized according to these settings at 514 and the settings are transmitted to the machine at 516. The user can then use the machine at 518 and information from such use can be gathered. When the user uses a machine, the user information can be associated with that session. The controller can receive a user identification that can be alpha-numeric or other information and can include features such as keycard, fingerprint, facial recognition, alphanumeric code, and the like for signing on to the machine and session. Once the user signs in, the setting and the hardware and equipment configuration can be set, including a workout routine, resistance, display format, load, repetitions, similar settings, and any combination thereof.

In one embodiment, a determination can be made that, based upon the gathered information, does the setting need to be modified for the next repetition at 520. If so, the modifications are made at 534 and transmitted to the machine at 516. Variation in the modifications can include progressive load modifications, static load modification between sessions, or any combination. The user and user data of the machine can be transmitted to one or more servers at 522.

The server can include computer readable instructions that analyze the information gathered at 524, determine if modifications to the workout scheme and rehabilitation plan are needed at 526 and if so, modify the workout scheme and rehabilitation plan at 528 for the next set, next session, next iteration, and the like. The modified changes are transmitted to the machine at 516. In one embodiment, if the results from the patent are acceptable at 530 the rehabilitation and/or workout can be ended at 532.

Figure 6:
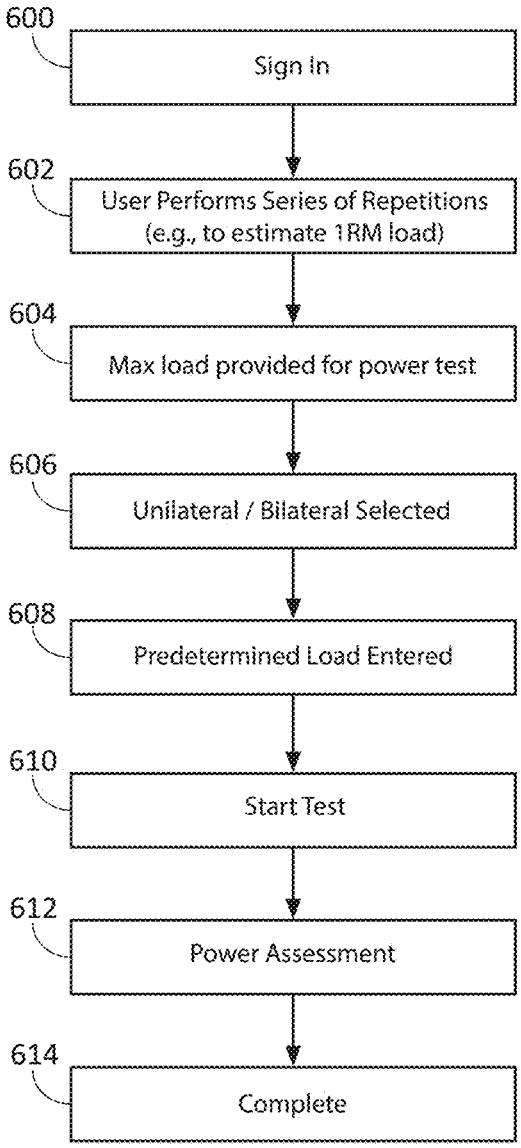
FIG. 6 is a flowchart of the operational aspects of the system.

Referring to FIG. 6, the computer readable instructions can determine a strength and power assessment for the user using one or more machines. The user or assisting individual can sign in which can include identification information, de-identified information, biometric information, each of which can be unique that can be received by the controller at 600. Signing in can be accomplished with the machine's display or through other means such as scanning an rfid or barcode. The system can perform a warm-up phase with the machine and then perform a series of repetitions to determine an estimated one repetition maximum (1RM) at 602. 1RM can represent the most load or resistance that can be performed by the user with maximum effort from the user in a single repetition. The system can predict the 1RM using methods such as multiple repetition maximum assessments, load-velocity analyses, and historical user data or aggregate user data or the like. For example, using the multiple repetition maximum method, the user can work up to a heavy load and have them perform as many repetitions as possible. The system can then use that load, number of reps, and/or velocity to estimate what their one repetition max would be. This information can be used to identify current strength levels and any of these processes can be completed on both limbs at the same time or on each limb individually.

According to the user information that is provided to or retrieved from the controller using one of the methods above for determining an estimated 1RM, a load can be determined for the power test at 604. In one embodiment, the user, trainer, practitioner or workout assistant can choose to run the power test up to a maximal strength load (1RM) or they may choose to run the test at a lower or higher load depending on the capabilities of the user and the recommendations of the computer readable instructions. With the collection of data, the aggregate dataset can also allow the system to provide an estimation based on the dataset. The system can also use characteristics of the user, determine datasets that are from users with similar characteristics and provide estimated or initial treatment plans for the new user.

Therefore, the system can use machine learning to develop initial power test loads from historical data collected. As the system develops these initial power test loads and presents these to the workout assistant, trainer or practitioner, the system can receive modifications to the initial plans. These modifications can be used to provide subsequent evaluation plans. For example, if an initial evaluation plan is developed for a user with certain characteristics and sets an initial load at X, the health care provider may modify this load to Y. Therefore, if the modifications occur routinely, or for a certain user, the system can provide subsequent evaluation plans with the load of Y, learning from the modifications of the health care provider.

A power test may be used to estimate a user's power curve. A test and analysis may include determining power velocity, peak power, maximal strength, and other metrics to develop a training routine. A power test can include an assessment that takes a user through several repetitions (e.g., in the range of 2 to 20) of gradually increased resistance leading up to a maximal load that was entered by the workout assistant or health practitioner. This assessment can provide data on velocity, power, force, range of motion, work etc. and generate the data that is shown in the Figures (e.g., FIG. 7) for each limb individually. The user or assisting individual can determine if the exercise will be performed unilateral or bilateral at 606 and provide input to the system, such as the controller, accordingly. A maximal load can be entered into the system. This load can be used to determine the repetition loads that will gradually increase as determined by the computer readable instructions. The controller is provided with the load or resistance at 608, the test starts at 610 and the user particulates in the exercise at 612 until the test is complete at 614. In one example, the user can complete one repetition at a time as fast as possible and then receives a rest period before completing the next rep. This example can be used to take the user through several repetitions of a gradually increasing load leading up to the resistance that was entered, or until the practitioner ends the assessment. The computer readable instructions can also determine the increase in the load according to a predetermined protocol or according to the real-time data received from each repetition from the user. Other power tests may involve a variety of similar protocols completing repetitions at various loads and maximal speeds to measure the performance metrics of the user.

The system can also learn from the performance of one or more users so that during an evaluation, the system can suggest incremental load increases or other modifications to the plan during the implementation of the evaluation. Evaluations with more accurate and reliable data sets can be used to provide suggestions for subsequent evaluation plans.

The data that is gathered during this power test is transmitted to one or more computer systems, locally or remotely. The computer system can receive data from other systems including workout assistant systems. For example, user criteria can be received from the medical record or past performance records of the user and can be used for the initial evaluation as well as the subsequent workout scheme and/or rehabilitation. The assessment data can be associated with the user record and can also be associated with each type of activity, exercise and machine including leg press, chest press, leg curl, upper row, other machines and any combination. A maximal load for each test can be received or calculated from this information as well as power velocity, peak power and other data points that can be received and used by the system for each limb.

The system and the computer readable instructions can evaluate the power test completed on one or both limbs. Each limb can be evaluated independently of the other limb. In one embodiment, the data from the series of repetition completed within a power assessment can be plotted. The variables included in the plots can be velocity, power, resistance, force, and the like.

Figure 7:
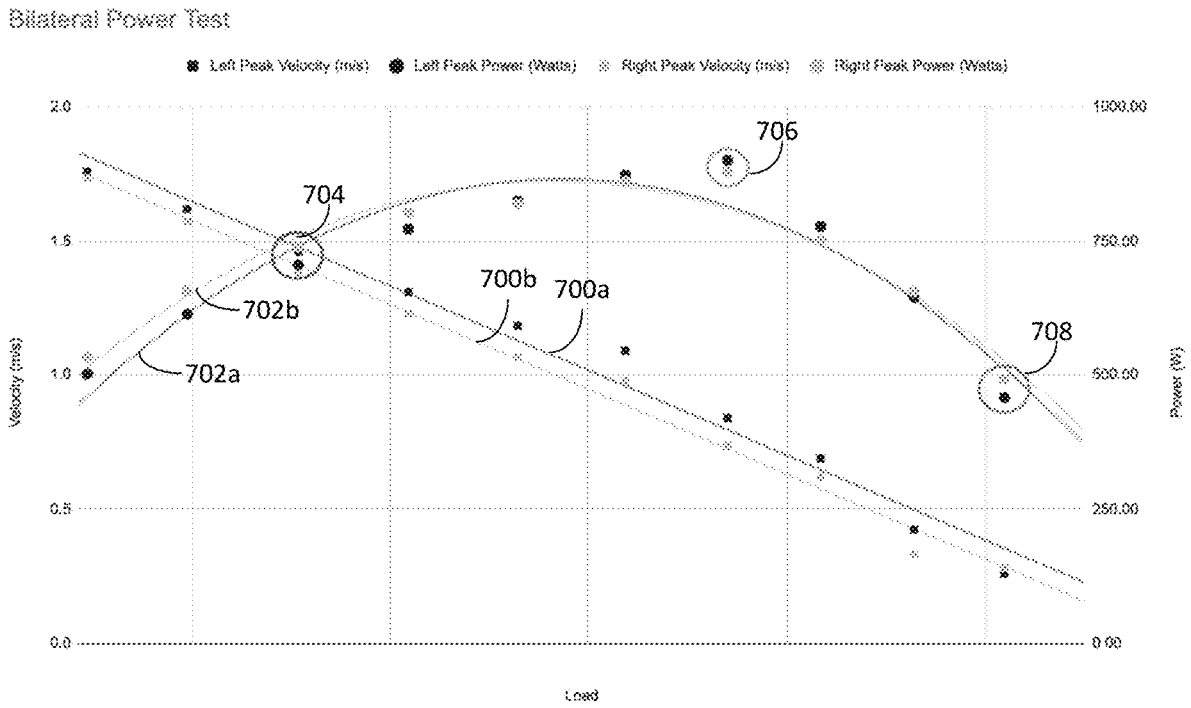
FIG. 7 is a graph representing output of the machine and system.

Referring to FIG. 7, the data that is collected from the assessment is shown. The velocity (in meters per second) of the left limb is shown as 700*a* and the right limb as 700*b*. The power (e.g., Watts) for the left limb is shown as 702*a* and the right limb as 702*b*. In one embodiment the lines of best fit can be determined for the left and right limbs' force-velocity relationship shown below. Further, a best fit analysis can be determined for the left and right limbs' power. Further, a best fit can be determined using data from the power test on that specific leg. All the data can be normalized prior to analysis.

The system can determine a line of best fit for left and right force-velocity relationships with the following equation:

$$y = mx + b$$

where y is the y-axis, m is the slope, x is the x-axis and b is the y intercept of a straight line.

The system can determine the line of best fit for left and right power relationships represented by the curves 702*a* and 702*b*. The best fit of the power curve can be determined by several methods including the following that can be implemented in computer readable instructions as an example:

$$y = Ax^2 + Bx + C$$

where y is the dependent variable, x is the independent variable, a is a coefficient, b is a coefficient, and c is a coefficient. Any number of methods can be used for the best fit and can include generating one line that minimizes the distance between the line and the gathered data for each limb. Therefore, this graph can show all power data and are not specific to peak power or power velocity and these points can be determined from the line(s). The data can be analyzed by the individual data points as well as any part of each line of best fit (for each limb). The differences between limbs at any one point or across several points can be calculated as bilateral differentials.

Peak power and power velocity can be represented by two points determined from the test data of each limb. These points can be visually determined and/or numerically defined from an algorithm. The value that is used for calculating the power velocity point and the power velocity bilateral differential can be in a range that can include point 704 where the power line and the velocity line intersect. These points can be determined from each leg individually (e.g., right leg power velocity and left leg power velocity). The power velocity points can have a corresponding force, load, average wattage, peak wattage, average velocity, and peak velocity and the like. The peak power and peak power bilateral differential can be calculated at 706 which can be the highest data point of power output. The peak power and peak power bilateral differential could also be calculated from the highest point of the power curve (line of best fit). These points can be visually determined and/or numerically defined from an algorithm. These points can be determined from each leg individually (e.g., right leg peak power and left leg peak power). The peak power point can have a corresponding force, load, average wattage, peak wattage, average velocity, and peak velocity and the like. The maximal load can be calculated at 708 where the last successful repetition performed by the user occurs or can be estimated based on the previous repetitions completed. These points can be determined from each leg individually (ie. right leg maximal load and left leg maximal load). The maximal load point can have a corresponding force, load, average wattage, peak wattage, average velocity, and peak velocity and the like. The system can provide and display strength, peak power and power velocity data as this data can be identified and compared between tests completed at different points in time. The power velocity, peak power, and maximal load points can be used to determine training loads, measuring physical functional ability, and the assist with a risk assessment of the potential for further injury or health risk.

It should be noted that bilateral differentials do not have to be specific to strength, peak power, or power velocity but rather can show an average across all or some repetitions. In one embodiment, an average power bilateral differential can be calculated by averaging repetitions involving high velocities and lesser forces. An average strength bilateral differential can be calculated from repetitions involving lower velocities and higher forces.

In one embodiment, current strength can be the estimated 1RM that was determined from the maximal exertion test, the final repetition performed on the power test, or an estimation from the dataset. The system can determine the current strength level of both arms and/or legs or each arm and/or leg individually, ideal strength level of limbs or limb individually, and bilateral differentials (e.g., difference between limbs across one or more repetitions) and display the information in graphical format as shown in the figures. For example, a male user's ideal bilateral lift may be a factor of (such as two times) the user's body weight. Different algorithms can exist for each exercise performed and each piece of exercise equipment. In addition, ideal levels for peak power and power velocity can be determined based on a percentage of ideal strength.

The system can also determine the current peak power level of both limbs and/or each limb independently. The system can also determine bilateral differentials at peak power. The system can also determine ideal peak power levels, if applicable. For example, if your ideal strength for lift press is 200 pounds your ideal Peak Power level could be 75% of that (e.g., 150 lbs.)

The system can also determine the current power velocity of both legs or each leg individually. The system can also determine bilateral differentials at power velocity. The system can also determine ideal power velocity levels, if applicable. For example, if your ideal strength for lifting is 400 pounds your ideal power velocity level could be 55% of that (e.g., 220 lbs.)

These values, strength, peak power, and power velocity can be determined for various machines representing different parts of the user and can include use of leg press, chest press, leg curl, upper row, latissimus dorsi (lat.) pulldowns, military presses, core rotations, leg extensions, deadlift, other work out machines and any combination. The dead lift machine itself can be used for deadlift, jumps, split squat, and a variety of similar exercises. Other exercises can be accomplished through similar machines, and the system can compare the information gathered from all exercises on the various machines to perform a whole-body analysis.

In one embodiment, once the assessment is performed on the machine and the baseline of performance established by the system according to the current and ideal levels of the target individual, the performance training program is created with the goal of reducing limb and quadrant asymmetries and improving strength and power to the ideal levels. The performance training program can be determined for each exercise performed on the present machine and this program can also be integrated with other machines that are connected to the system.

In the case of a neurologic or neuromuscular impairment these points (maximal strength, peak power, power velocity) may be identified from unilateral power tests because it is expected that there will be large discrepancies between the data for each limb. This means that there can be a peak power point and a power velocity point for the right limb and for the left limb. These points can include data on force, load, velocity, wattage, range of motion, and others. These points can provide markers for comparison and interpretation. As an example, for stroke users, the system can assist with bringing power velocity of the affected limb up to the same as the unaffected limb so that the load, velocity, and wattage of the previously affected limb is equal to that of the unaffected limb. Additionally, the system can assist with achieving equal peak power and strength between the limbs. Therefore, this system can assist the user to maximize their own ability without assistance from a trainer, or the like.

In one embodiment, this machine may be used within the system to evaluate and prescribe training for bilateral deadlift strength, peak power, and power velocity. For example, using the present machine, if a target individual's lower pull performance (as measured by the deadlift) is 20% below their ideal strength and the other quadrants (as measured by other machines in the system) are all close to ideal (<5%) then the performance training program will be specifically targeted to improve the lower pull performance as this will reduce potential injury risk.

When a target individual is using this machine as part of the system, the system can learn from the target individual's use and gather data so that the training protocol for the machine can change over time and be specific to that target individual. One example would include a target individual completing an evaluation and having a large peak power deficit in their lower pull quadrant (e.g. deadlift) which leads to a poor peak power symmetry score. The system would prescribe a training program using the present machine targeted at improving peak power symmetry. The system can then take a stair-stepper approach to monitoring power output and increasing load until the peak power symmetry reaches a specific threshold. Once the desired target is reached, the system can alter the training accordingly. This process can be autoregulated by the computer based on real-time training data so that the training programs are always specific to the user's current performance without having to rely on a subsequent evaluation to alter the protocol.

For example, if the user is prescribed a training program for a lower pull peak power deficit using the deadlift machine, the loads and wattages of their exercise will be monitored for improvement. In one embodiment, during a training session if they exceed their previous wattage by more than 10%, the computer can automatically adjust their resistance to a higher load. While the progression is determined by the target individual's progress and the computer readable instructions learning from the process, an illustrative example of the workout using the present machine is shown below.

Workout 1:

Deadlift: 3 sets of 6 repetitions at peak power load (100 lbs.), 2 sets of 6 repetitions at 105 lbs., 2 sets of 4 repetitions at 110 lbs. The system will monitor power output in watts after each set.

Workout 2:

Deadlift: 3 sets of 6 repetitions at peak power load (105 lbs.), 2 sets of 6 repetitions at 110 lbs., 2 sets of 4 repetitions at 115 lbs. The system will monitor power output in watts after each set and compare to Week 1 wattages. It will then evaluate percent change in wattage to adjust loads for the next workout.

As can be seen, the machine can be used within the system for specific training prescriptions which target the deficits identified during the evaluation.

Figure 8A:
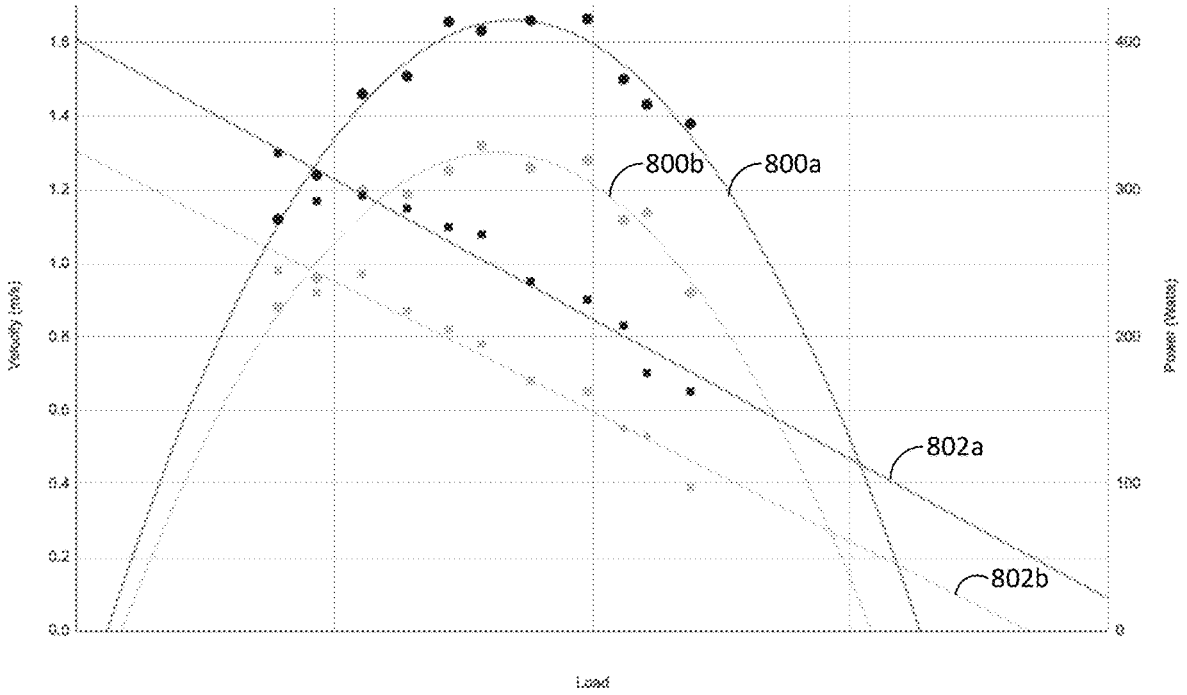
FIG. 8A is a graph representing output of the machine and system.
Figure 8B:
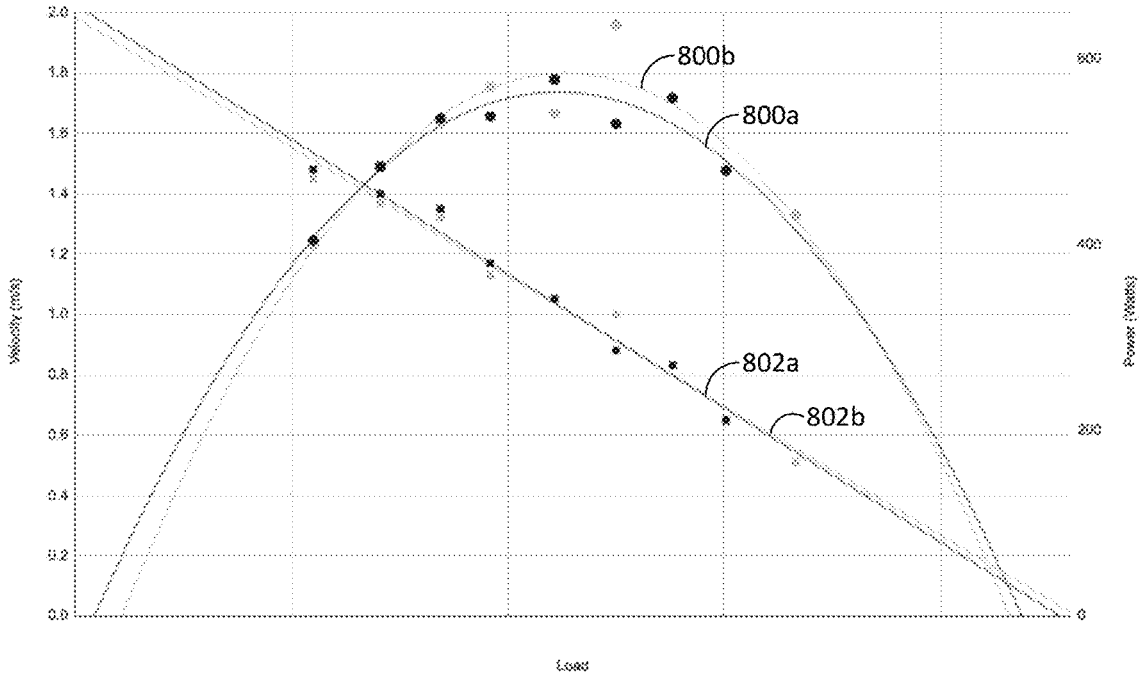
FIG. 8B is a graph representing output of the machine and system.

Referring to FIG. 8A, one embodiment shows pre-training graphical results of an assessment from the present machine. FIG. 8B shows the post-training graphical results of an assessment on the present machine. The velocities and power outputs are generally higher in FIG. 8B compared to FIG. 8A. The points at which power velocity and peak power occur have higher power output and occur at higher resistances in FIG. 8B. FIG. 8A also shows that the right limb is underperforming compared to the left limb in regard to both velocity (802*b* v 802*a*) and power (800*b* v 800*a*). This represents improved performance and symmetry on the present machine that would translate to improved physical performance and functioning for the user.

The machine herein can be used by the user and can be used in communications with the system having other machines and can follow the same processes and functionality provided by the system as described where with each machine having the ability to provide its own set of data. In one embodiment, ideal strength, peak power and power velocity levels can differ per exercise and per machine. In one embodiment, the user's current values (e.g., strength, peak power, power velocity, etc.) can be determined for each machine regardless of what machine is used. In similar manner, the user's current values can be determined for each exercise and be compared with data gathered from other exercises and machines utilized within the system.

From these data points from the present machine or from one or more machines, the system can calculate a multi-quadrant evaluation of the user. For example, these assessments, evaluations, and calculations can be determined for the right hemisphere, left hemisphere, right side above the waist, right side below the waist, left side above the waist, left side below the waist and any combination as well as left and right-side core (trunk). Similar assessments can be achieved for other divisions of the body. These assessments, evaluation and calculations can be determined for the right arm, left arm, right leg and left leg, right core, left core, right hemisphere, left hemisphere, quadrants, specific muscle groups, and any combination.

From these evaluations, rehabilitation and workout plans can be created or modified. According to the evaluation and assessment, the rehabilitation and workout programs can be determined for each quadrant and for each machine or exercise. For example, in the case that the user has a weaker left leg than right leg, an occurrence that can result from a stroke, the system can design a rehabilitation plan that includes a slower and lesser load or resistance profile for the weaker leg designed to rehabilitate the weaker leg to the same strength level of the stronger leg as well as improve the strength bilateral differential. The system can also design a rehabilitation plan that improves strength levels and strength symmetry (strength comparisons across body quadrants, ie. lower push and lower pull strength) and reduces variance across multiple machines. The system can also create or modify a rehabilitation plan that seeks to improve peak power and reduce bilateral differentials as well as increasing symmetry and reducing variance across multiple machines. The bilateral differentials can be reduced for the repetition at which peak power occurs and across several repetitions (average power differential). The system can also create or modify a rehabilitation plan that seeks to improve the power velocity and reduce bilateral differentials. The system can also design a rehabilitation and workout plans that seek to increase power velocity levels and power velocity symmetry and reduce variance across multiple machines. The bilateral differentials can be reduced for the repetition at which power velocity occurs and across several repetitions (average power differential). Training programs may be designed for one or more of the above-mentioned goals.

From the initial assessment and evaluations, rehabilitation and workout programs are created. For example, a workout program may include strength and power training, motor skill exercises, mobility training, constraint induced therapy, range of motion therapy, electrical stimulation, and the like.

When a user is using the machine, the system can learn from the user's use and data gather so that the rehabilitation and/or workout protocol can change over time and be specific to that user. One example would include the user completing a bilateral power test over a series of repetitions, with data collected for each repetition and the data from the left and right limb can be compared. When evaluating the power velocity point, it would be expected to see that the injured limb would have a power velocity point at a lower load (for example in an earlier repetition) than the uninjured limb. This power velocity point be can designated as the first target. It can then be decided to begin the training of the injured limb at this power velocity load. The system can then take a stair-stepper approach to increasing velocity and then increasing load until the user shows that the injured limb is at the same power velocity load and wattage as the uninjured limb. This process can be autoregulated by the computer based on real-time data feedback. For example, if the user is exceeding their previous wattage by more than 10%, the computer can automatically adjust their resistance to a higher load. While the progression is determined by the user's progress and the computer readable instructions learning from the process, an illustrative example of the process is shown below.

The system can determine that the power velocity load for the uninjured limb is 125 lbs. The power velocity load for the injured limb is 90 lbs. From this information the following can be calculated by the system:

Week 1: 2 sets of 8 repetitions at 90 lbs. load; 1 set of 8 consecutive repetitions at 90 lbs. load; and 2 sets of 8 repetitions at 95 lbs. load.

Week 2: 1 set of 8 repetitions at 90 lbs. load; 1 set of 8 repetitions at 95 lbs. load; 1 set of 8 consecutive repetitions at 95 lbs. load and 2 sets of 8 repetitions at 100 lbs. load.

Week 3: 1 set of 8 repetitions at 95 lbs. load; 1 set of 8 repetitions at 100 lbs. load; 1 set of 8 consecutive repetitions at 100 lbs. load and 2 sets of 8 repetitions at 105 lbs. load.

As can be seen, the system allows for targeting training exactly where their current ability is and allowing for progression over time. These programs can be automatically modified on a rep-by-rep, set-by-set, or day-by-day basis due to measured changes in performance In the case of rehabilitation, once the assessment is performed and the baseline of performance established according to the un-impaired limb, the rehabilitation plan is created with the goal of the impaired limb being exercised so that the neurological system of the user is actuated to increase the neural output of the user and improve the power production of the impaired limb. Referring to FIGS. 8A and 8B, the graphical results of an assessment and evaluation session of a user as shown. In this example, the left power 800*a* and the left velocity 802*a* show that the left leg is un-impaired. The right leg, however shows lesser values and the difference in the performance analysis can be seen. The right leg power output is 800*b* and the right velocity is 802*b*. After the user is implementing the rehabilitation plan or has completed the rehabilitation plan, FIG. 8B shows that the power outputs and velocity of each leg is more similar post rehabilitation.

In one embodiment, the sensors and controller includes an output of data without calculations. In this case, the controller serves as a data source for computer readable instructions that can be disposed locally or remote to the equipment.

The deadlift machine may provide the ability to complete a power test which can include an assessment that takes a target individual through a number of repetitions (e.g., in the range of 2 to 20) of gradually increased resistance leading up to a near maximal load that was entered into or calculated by the system. This assessment can provide data on velocity, power, force, range of motion, work etc. and generate such data that is shown in the FIGS. 8A and 8B for each limb individually. The target individual or assisting individual can determine if the exercise will be unilateral or bilateral and provide input to the system, such as the controller, accordingly. A maximal load (1RM), or estimated maximal load, can be entered into the system. The maximal load can be used to determine the repetition loads that will gradually increase as determined by the computer readable instructions. The controller is provided with the load or resistance, the test starts and the target individual particulates in the exercise until the test is complete. In one example, the target individual can complete one repetition at a time as fast as possible and then receives a specific rest period before completing the next rep. This example can be used to take the target individual through several repetitions of a gradually increasing load leading up to maximal or near-maximal load. The computer readable instructions can also determine the increase in the load according to the data received from each repetition from the target individual. The test can be completed when the target individual can no longer complete a full repetition or when the practitioner decides to end the test.

The data that is gathered during this power test is transmitted to one or more computer systems, locally or remotely. The computer system can receive data from other systems including healthcare provider systems. For example, target individual criteria can be received from the medical records or training records of the target individual and can be used for the initial evaluation as well as the subsequent training scheme and/or rehabilitation. The assessment data can be associated with the target individual record and can be also associated with each type of activity, exercise and machine including leg press, chest press, deadlift, upper row, core rotation, leg curl and other machines and any combination. A maximal load for each test can be received or calculated from this information as well as power velocity, peak power and other data points that can be received and used by the system for each side of the body.

The system and the computer readable instructions can evaluate the power test completed on one or both sides of the body. In one embodiment, the data from the series of repetition completed within a power assessment can be plotted. The variables included in the plots can be velocity, power, resistance, force, and the like.

For example, the data that can be generated can include velocity (e.g., meters per second) of the left limb as well as for the right limb. The power (e.g., Watts) for the left limb can be provided as well as for the right limb. In one embodiment, when graphed, the lines of best fit can be determined for the left and right limbs' force-velocity relationship. Further, a best fit analysis can be determined for the left and right sides' power. Further, the best fit can be determined using data from the power test on that specific side of the body.

What is claimed is:

1. A variable load bilateral deadlift machine comprising:

a frame;

a controller in communication with a display;

a set of independent lever arms pivotally carried by the frame and attached to a load assembly; and a load controller adapted to receive a load applied to the load assembly;

wherein the controller is adapted to receive load input, determine a corresponding load setting for the load controller, transmit the load setting to the load controller, receive performance information including lift speed, power, weight, and range of motion of each side of a body of a user independently and display the performance information on the display.

2. The machine of claim 1 wherein the controller is adapted to transmit the performance information to an aggregation server.

3. The machine of claim 1 wherein the controller is adapted to receive an initial workout plan, modify the initial workout plan according to the performance information, and display the modified workout plan to the user at a next workout session.

4. The machine of claim 1 wherein the controller is adapted to display the performance in the display as a graph with target and actual data displayed.

5. The machine of claim 1 wherein the controller is adapted to receive a third party performance data from a remote user of other machines and create an initial workout plan according to the third-party performance data.

6. The machine of claim 5 wherein the controller is adapted to create the initial workout plan according to physical characteristics of the user.

7. The machine of claim 5 wherein the controller is adapted to create the initial workout plan according to a baseline measurement of the user.

8. The machine of claim 1 wherein the load controller includes fluid cylinders.

9. The machine of claim 8 wherein the load controller includes a fluid reservoir in fluid communication with the fluid cylinders.

10. The machine of claim 1 wherein the controller is adapted to receive input and provide output to a portable computer device in communication with the controller.

11. The machine of claim 1 further comprising sensors for measuring the weight, the load, the lift speed, a drop speed, the range of motion, and grip strength.

12. The machine of claim 1 further comprising a force plate configured to gather unilateral time series data during use of the machine.

13. A variable load bilateral deadlift machine comprising:

a frame;

a set of independent lever arms pivotally carried by the frame;

a handle attached to each lever arm having a first button adapted to increase a load when actuated and a second button a adapted to decrease the load when actuated; and a controller adapted to receive a load input from the lever arms, determine a corresponding load setting, receive performance information including lift speed, power, weight, and range of motion of each side of a body of a user independently and display the performance information on a display.

14. The machine of claim 13 wherein each handle is connected to the corresponding lever arm with a variable height connector.

15. The machine of claim 13 further comprising a floor plate adapted to measure a force applied to the floor plate when the handles are lifted.

16. The machine of claim 15 where in the floor plate transmits the force applied to the floor plate to the controller.

17. A variable load bilateral deadlift machine comprising:

a frame;

a set of in dependent lever arms pivotally carried by the frame; and a handle attached to each lever arm adapted to increase a load in a first actuation and to decrease the load in a second actuation;

wherein the handle is connected to the lever arm with a variable height connector.

18. The machine of claim 17 wherein the lever arms measure a force applied to a load assembly when the lever arms are actuated.

19. The machine of claim 18 further comprising a controller adapted to received load information from the lever arms and display the load information on a display.

20. The machine of claim 17 further comprising a floor plate attached to the frame and adapted to measure a force applied to the floor plate when the handles are lifted.

* * * * *